United States Patent [19]

Clark et al.

[11] Patent Number: 4,662,817

[45] Date of Patent: May 5, 1987

[54] APPARATUS AND METHODS FOR PREVENTING COMPRESSOR SURGE

[75] Inventors: Jim C. Clark; George L. Perrone, both of Phoenix, Ariz.

[73] Assignee: The Garrett Corporation, Los Angeles, Calif.

[21] Appl. No.: 767,565

[22] Filed: Aug. 20, 1985

[51] Int. Cl.[4] ..... F01D 17/08

[52] U.S. Cl. ..... 415/1; 415/17; 415/27

[58] Field of Search ..... 415/1, 17, 21, 23, 26, 415/27, 49; 73/714, 115; 60/39, 29

[56] References Cited

U.S. PATENT DOCUMENTS

| | | | |
|---|---|---|---|
| 2,470,565 | 5/1949 | Loss | 415/27 |
| 2,930,520 | 3/1960 | Abild | 415/17 |
| 2,965,285 | 12/1960 | Schorn et al. | 415/17 |
| 3,073,511 | 1/1963 | Knight et al. | 415/17 |
| 3,156,437 | 11/1964 | Mercier | 415/23 |
| 3,276,674 | 10/1966 | Hens | 415/1 |
| 3,327,933 | 6/1967 | Baumann et al. | 415/23 |
| 3,362,624 | 1/1968 | Endress | 415/1 |
| 3,426,964 | 2/1969 | Silvern | 415/49 |
| 3,472,487 | 10/1969 | Moellmann | 415/23 |
| 3,638,428 | 2/1972 | Shipley et al. | 415/145 |
| 3,677,000 | 7/1972 | Thomson | 415/1 |
| 3,706,510 | 12/1972 | O'Connor | 415/145 |
| 3,901,620 | 8/1975 | Boyce | 415/1 |
| 3,930,746 | 1/1976 | Kronogard | 415/149 |
| 4,156,578 | 5/1979 | Agar et al. | 415/1 |
| 4,164,033 | 8/1979 | Glennon et al. | 415/17 |
| 4,164,035 | 8/1979 | Glennon et al. | 415/17 |
| 4,203,701 | 5/1980 | Abbey | 415/1 |
| 4,205,941 | 6/1980 | Fradin | 415/1 |
| 4,230,437 | 10/1980 | Bellinger et al. | 415/1 |
| 4,378,194 | 3/1983 | Bandukwalla | 415/49 |
| 4,464,720 | 8/1984 | Agarwal | 415/1 |

FOREIGN PATENT DOCUMENTS

| | | | |
|---|---|---|---|
| 822084 | 10/1959 | United Kingdom . | |
| 1048130 | 10/1983 | U.S.S.R. | 415/115 |

*Primary Examiner*—Robert E. Garrett
*Assistant Examiner*—John Kwon
*Attorney, Agent, or Firm*—J. Richard Konneker; Curt Harrington; Albert J. Miller

[57] ABSTRACT

To prevent surge in a compressor, the flow therethrough is automatically altered when the static pressure differential taken laterally across one of its diffuser vanes approaches a magnitude indicative of a surge condition.

8 Claims, 3 Drawing Figures

APPARATUS AND METHODS FOR PREVENTING COMPRESSOR SURGE

BACKGROUND OF THE INVENTION

The present invention relates generally to compressors, and more particularly, provides novel apparatus and methods for preventing compressor surge.

A particularly difficult problem arising in the design and operation of compressors used in gas turbine engines is the prevention of surge—a condition commonly defined as the lower limit of stable operation of a compressor, and generally comprising the undesirable reversal of fluid flow through the compressor which oftentimes causes damaging pulsation therein. In the past, a variety of solutions to this surging problem have been proposed. However, for a number of reasons, such as complexity, inefficiency, or simply the relatively high cost of such prevention techniques, none of these conventional approaches to surge prevention has proven entirely satisfactory.

As an example, several conventional surge systems use an open loop scheduling technique that typically requires inputs from a number of parameters such as inlet guide vane position, bleed air total pressure, bleed air static pressure, engine speed, altitude, electrical load and the like. The use of these numerous control parameters typically results in expensive sensors, reliability degradation, and complex logic circuitry to eliminate compressor surging. Precise overall control accuracy is difficult to achieve with such conventional systems due to a combination of sensor inaccuracies and the actual definition of the particular compressor's surge line. Since these particular surge prevention systems are of the open loop type, a "worst case" surge control line must be used that will be suitable for all engines in which the particular compressor would be used. This worst case design necessity results in wasted surge bleed flow and higher than necessary overall fuel consumption. Additionally, various of the sensors required to generate output signals indicative of these parameters must, of necessity, be positioned in the compressor's air flow path. This, of course, tends to interfere with the compressor's overall aerodynamic efficiency.

Another conventional approach, employed in the compressor's diffuser section, is to tilt one of the diffuser vanes relative to the other vanes so that the tilted vane's incidence angle is slightly increased relative to the other vanes. As the compressor approaches a surge condition, the tilted vane begins to stall as air flow begins to separate therefrom. Upon sensing this single vane stall condition, the surge control system automatically reduces fuel flow to the turbine engine to prevent complete compressor stall. However, a significant disadvantage of this system is that the "tilted" vane actually increases the likelihood that the compressor will surge prematurely since the initial stall condition of any particular vane normally is the event that triggers surge. Additionally, this system is of necessity an "on-off" type which is considerably less desirable than a modulating type control system.

Still other conventional systems attempt to avoid compressor surge by utilizing complicated and relatively expensive fuel scheduling systems which automatically change the engine fuel flow to avoid or bypass operating regions of the compressor in which surge may occur. These fuel control-oriented systems are typically characterized by high cost, operating inefficiency, and increased overall fuel consumption.

Accordingly, it is an object of the present invention to provide apparatus and associated methods for preventing compressor surge which eliminate or minimize above-mentioned and other problems.

SUMMARY OF THE INVENTION

The present invention provides a surge prevention system which detects impending compressor surge by sensing the static pressure differential between opposite side surfaces of a diffuser vane of the compressor, and utilizing this sensed static pressure differential to generate an output signal indicative of impending surge. When the magnitude of the output signal reaches a predetermined level, the system automatically alters flow through the compressor to prevent a surge condition therein.

In a preferred embodiment of the invention, the output signal is used to modulate a surge bleed valve which, when opened, increases the flow through the compressor thereby avoiding surge. In such preferred embodiment of the invention, the value of the output control signal is equal to $(P_1-P_2)/(P_1-P_3)$ where $P_1$ is a reference static pressure generated by the compressor, $P_2$ is a pressure indicative of the static pressure on the pressure side surface of a diffuser vane adjacent its leading edges, and $P_3$ is a pressure indicative of the static pressure on the suction side surface of a diffuser vane adjacent its leading edge. Via small conduits operatively connected to the diffuser section of the compressor, pressure signals corresponding to $P_1$, $P_2$, and $P_3$ are transmitted to an electronic control unit (ECU) which outputs an electrical control signal having a magnitude equal to $(P_1-P_2)/(P_1-P_3)$. This electrical output signal is received by a comparator which also receives an adjustable electric setpoint signal indicative of a desired value of the parameter $(P_1-P_2)/(P_1-P_3)$. The comparator outputs an electrical control signal indicative of the difference between the magnitudes of the setpoint signal and the signal received from the ECU, and utilizes this control signal to modulate the surge bleed valve.

DETAILED DESCRIPTION

Figure 1:
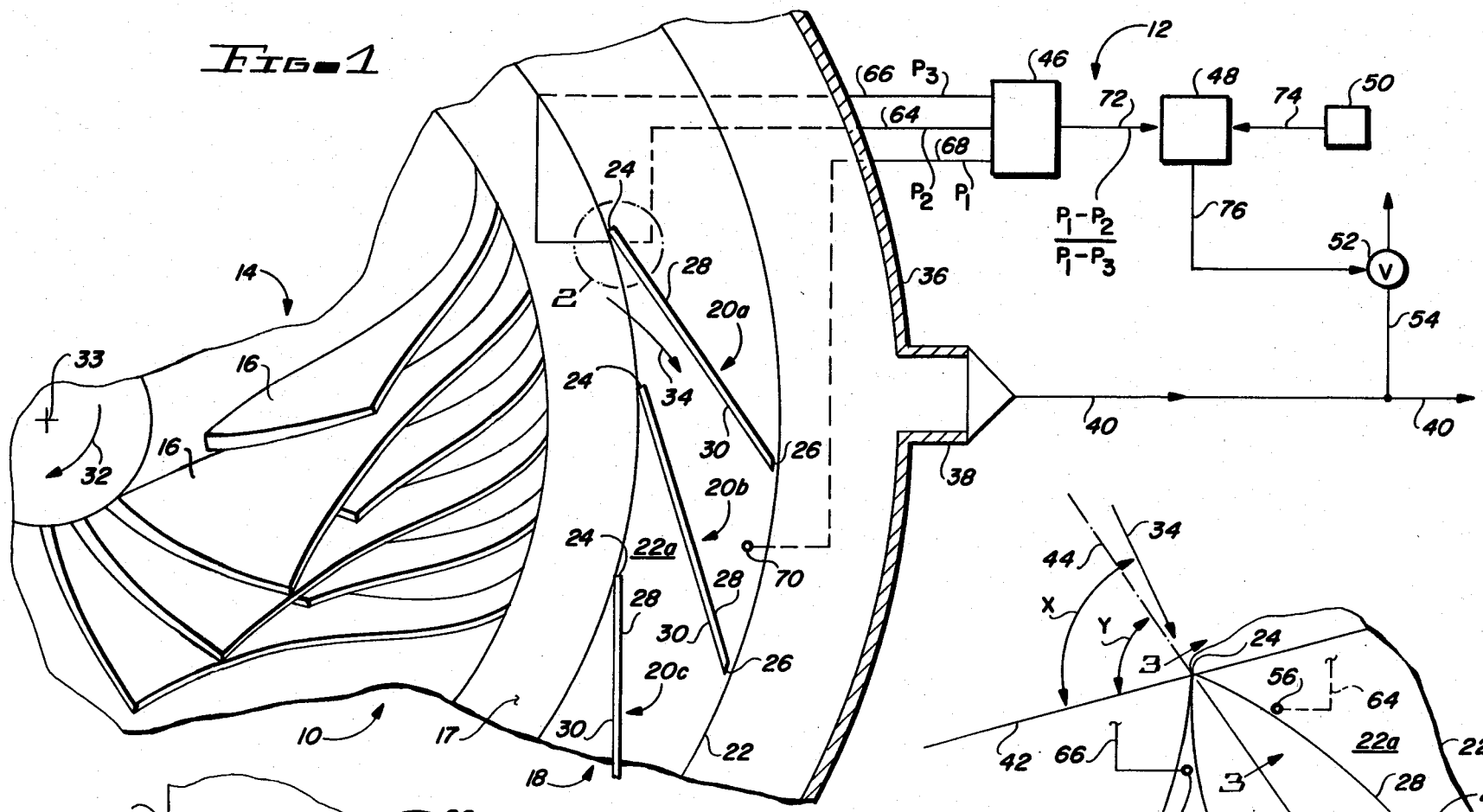
FIG. 1 is a fragmentary cross-sectional view through a representative centrifugal compressor to which is connected a schematically depicted control system embodying principles of the present invention and utilized to prevent surging of the compressor.

Cross-sectionally illustrated in FIG. 1 is a centrifugal compressor 10 which is protected from surging by a surge prevention system 12 that embodies principles of the present invention. The compressor 10 has a rotatable impeller section 14 having a circumferentially spaced series of curved blades 16 fixedly secured thereto. Outwardly circumscribing the impeller section 14, and spaced therefrom by a vaneless diffuser space 17, is an annular diffuser section 18 which comprises a circumferentially spaced series of stationary diffuser vanes 20 (representative vanes 20*a*, 20*b* and 20*c* being depicted in FIG. 1) which are fixedly secured between an annular upper plate (not shown) and an annular lower plate 22. Each of the diffuser vanes 20 has a leading end 24, a trailing end 26, a pressure side surface 28, and a suction side surface 30.

During operation of the compressor 10, the impeller section 14 is rotationally driven, as indicated by the arrow 32, in a clockwise direction about a rotational axis 33. Such rotation draws air 34 into the compressor, compresses it in the impeller section, and forces the compressed air outwardly through the vanes 20 of diffuser section 18 into a collection scroll 36 having an outlet 38. The diffused air entering the scroll 36 is forced outwardly through its outlet 38 into a main supply air duct 40 for delivery to a compressed air-receiving apparatus or system (such as a turbine engine combustor or a pneumatically driven system).

Figure 2:
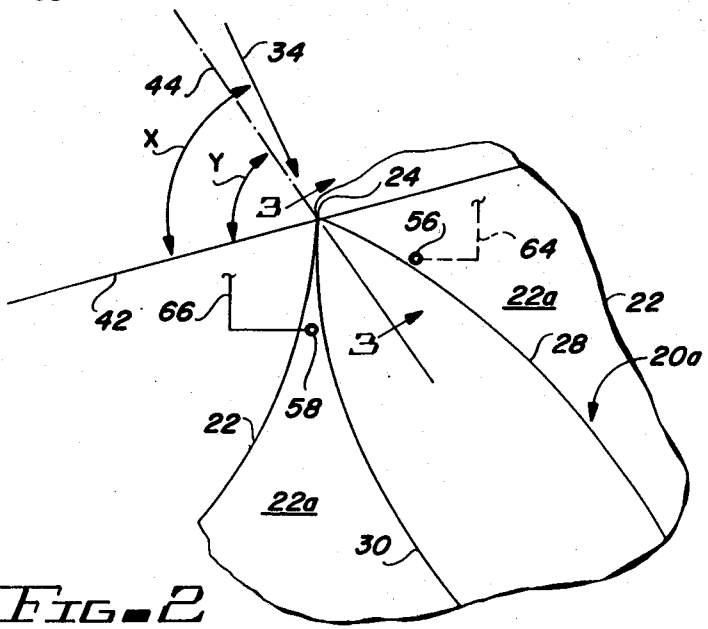
FIG. 2 is an enlarged, partially schematic plan view of a leading edge portion of one of the compressor diffuser vanes generally within the dashed area "2" in FIG. 1.

Referring to FIG. 2, it is known that compressor surge occurs when the angle of "incidence" of the compressed air 34 striking the diffuser vanes 20 becomes sufficiently high. This incidence angle is commonly defined as being the difference between the flow angle X and the blade angle Y, each such angle being measured relative to a reference line 42 which extends radially through the compressor's axis of rotation 33 and intercepts the leading end 24 of the particular diffuser vane 20 (vane 20*a* being shown in FIG. 2). More specifically, the flow angle X is defined as the angle between the radially extending reference line 42 and the direction of the compressed air 34 striking the leading vane edge 24, while the blade or vane angle Y (which is substantially identical for all of the diffuser vanes of the compressor 10) is the angle between the reference line 42 and the center line 44 of the representative vane 20*a* at its leading end portion. Compressor surge is experienced when the angle of incidence (i.e., X–Y) reaches a sufficiently high positive value.

In developing the present invention, it was discovered that the static pressure differential between the pressure and suction side surfaces of a given diffuser vane 20 is very precisely indicative of this angle of incidence, and therefore, of a compressor surge condition as well when the incidence angle is of a sufficiently high positive value. As will now be described, the surge prevention system 12 utilizes this discovery to detect impending surge in the compressor 10 and to automatically prevent the actual onset of surge by altering the flow through the compressor. The surge prevention system 12 (FIG. 1) comprises an electronic control unit (ECU) 46, a signal comparator 48, an adjustable setpoint signal generator 50, and a surge bleed valve 52 which is operatively positioned in a surge bleed duct 54 that defines an outlet branch of the main supply duct 40. Signal generator 50 may be a separate component as illustrated, or an integral component of the comparator 48 which may simply be adjusted to vary the setpoint of the comparator.

Figure 3:
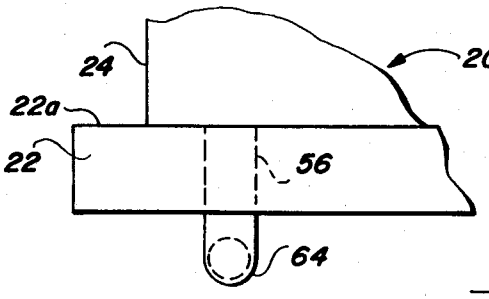
FIG. 3 is a fragmentary cross-sectional view taken through the leading edge portion of the diffuser vane along line 3—3 of FIG. 2.

Referring to FIGS. 2 and 3, the static pressure differential across diffuser vane 20*a* is sensed by forming a pair of small bores or sensing passages 56,58 upwardly through the annular diffuser plate 22. The bore 56 opens outwardly through the upper side surface 22*a* of the bottom diffuser plate 22 immediately adjacent the pressure side surface 28 near the leading vane end 24, while the bore 58 opens outwardly through the upper plate surface 22*a* immediately adjacent the suction side surface 30 near the leading end 24. The bottom ends of the bores 56,58 are respectively connected to first ends of two small pressure transmission conduits 64,66 which have their opposite ends operatively connected to two of three inlets on the input side of ECU 46 and extended below the diffuser plate 22 as illustrated in FIG. 1.

During operation of the compressor 10, conduit 64 transmits to the electronic control unit a pressure signal $P_2$ having a magnitude indicative of the static pressure along the pressure side surface 28 of vane 20*a* adjacent its leading end 24. Similarly, conduit 66 transmits to the ECU a pressure signal $P_3$ having a magnitude indicative of the static pressure along the vane's suction side surface 30 adjacent its leading end 24. A reference static pressure signal, $P_1$, is transmitted to the ECU's third inlet by means of a third small pressure transmission conduit 68 which extends below the scroll 36 as viewed in FIG. 1. Conduit 68 is connected at an end thereof to a small pressure sensing opening 70 which extends upwardly through the diffuser plate 22 and terminates along its upper surface 22*a* midway between an adjacent pair of trailing vane ends 26.

The ECU 46, via an electrical output lead 72, generates an output signal having a magnitude equal to the parameter $(P_1-P_2)/(P_1-P_3)$. This output signal parameter, which represents a comparison of each of the static pressures $P_2$ and $P_3$ to the reference static pressure $P_1$ generated by operation of the compressor, is indicative of the static pressure differential measured laterally across a representative diffuser vane such as the vane 20*a*. While other output parameters indicative of this static pressure differential could be utilized, it has been found that the use of this particular parameter significantly enhances the overall accuracy of the surge prevention system 12.

As an example, the output parameter $P_2-P_3$ (i.e., the actual static pressure differential taken laterally across a vane 20) could be directly utilized. However, it has been found that the accuracy of this simplified parameter, as one predictive of impending compressor surge, is adversely affected by changes in ambient conditions such as temperature and pressure. While this somewhat diminished predictive accuracy may be entirely suitable in some applications, it is preferable to utilize this lateral pressure differential in a manner which will very accurately detect surge impendency at all ambient and compressor operating conditions.

This is exactly what the use of the reference static pressure $P_1$ accomplishes. Specifically, the use of the pressure $P_1$ in the parameter $(P_1-P_2)/(P_1-P_3)$ has been found to uniquely utilize the lateral pressure differential $P_2-P_3$ as a predictor of incipient surge in a manner maintaining a high degree of surge-predictive accuracy over the entire range of ambient and compressor operating conditions. Stated otherwise, regardless of changes in ambient conditions or compressor speed, the use of compressor-generated reference pressure $P_1$ in such parameter automatically compensates for changes in both ambient conditions and compressor operating points.

It should be noted that, if desired, the reference pressure $P_1$ could be the ambient pressure itself. However, the use of ambient pressure as the reference pressure only compensates for changes in ambient conditions—it does not automatically adjust the value of the generated parameter $(P_1-P_2)/(P_1-P_3)$ for changes in compressor speed. While this limited accuracy compensation may be fully satisfactory in a variety of applications, the use of the compressor-generated pressure $P_1$, as described, is clearly preferable for the previously discussed reasons.

Referring now to FIG. 1, the set point signal generator 50 is used to transmit to the comparator 48, via an electrical lead 74 (or otherwise if the signal generator is an integral component of the comparator), an input signal indicative of the desired value of the pressure comparison parameter $(P_1-P_2)/(P_1-P_3)$. Comparator 48 automatically compares the magnitudes of the two input signals received through leads 72,74 and responsively transmits to the surge bleed valve 52, via an electrical output lead 76, a control signal having a magnitude indicative of the difference between the desired value and the sensed value of the parameter $(P_1-P_2)/(P_1-P_3)$. This control signal is used to modulate the surge bleed valve 52 in a manner which will now be described.

For purposes of illustrating the operation of the surge prevention system 12, let it be assumed that the surge bleed valve 52 is in a closed position so that all of the air discharged from the compressor 10 is being supplied via duct 40 to the particular end apparatus or system, and that the compressor is operating at a point satisfactorily remote from its surge line. In the event that the demand for supply air flowed through duct 40 is diminished (for example by the closing of an inlet supply valve in the end apparatus or system), the volume of air flowed through the compressor is concomitantly diminished. This causes the angle of incidence at each of the vanes 20 to increase, thereby increasing $P_2$ and decreasing $P_3$. The resultant increase in the lateral static pressure differential $P_2-P_3$ lowers the value of the parameter $(P_1-P_2)/(P_1-P_3)$, thereby indicating the approach of a compressor surge condition. When the value of such parameter decreases to a certain level (which, as previously discussed, is indicative of surge at all ambient conditions and compressor operating points) compressor surge begins.

To prevent the actual onset of surge in the compressor 10, the magnitude of the setpoint signal in lead 74 is set so that when the value of the parameter $(P_1-P_2)/(P_1-P_3)$ decreases to a value approximately twenty percent higher than the actual surge value thereof, the comparator 48 outputs, via lead 76, a control signal which modulates the surge bleed valve 52 toward its open position. The opening of the surge bleed valve causes compressor discharge air to be dumped to ambient through the branch duct 54, thereby increasing the flow through the compressor.

This increased flow decreases the angle of incidence at each of the diffuser vanes and correspondingly decreases the lateral pressure differential $P_2-P_3$ to move the compressor operating point further from the surge line. This alteration of flow through the compressor in response to the detection of impending surge uniquely prevents the actual onset of surge. When the end apparatus or system supply air demand returns to its previous level, the value of the parameter $(P_1-P_2)/(P_1-P_3)$ automatically increases in response to the increased air flow through duct 40 (due to the corresponding decrease in the angle of incidence and the pressure differential $P_2-P_3$). In turn, this alters the output signal in lead 76 to return the surge bleed valve 52 to its closed position.

From the foregoing it can be seen that the system 12 provides a uniquely simple and relatively inexpensive method for reliably preventing compressor surge at all ambient conditions and compressor operating points. Importantly, since only static pressures need be sensed, no portion of the system in any manner intrudes into compressor flow spaces, thereby eliminating the aerodynamic efficiency losses commonly associated with conventional systems having sensing devices which must intercept and partially block part of the compressor flow.

Further, the system 12, by simple adjustment of the comparator 48, can be used on a wide variety of compressors having diverse surge characteristics. Additionally, the use of the system 12 eliminates the previous necessity in various surge prevention systems of utilizing complex fuel scheduling circuitry to avoid potential surge-prone compressor operating regions.

It should be noted that various modifications could be made to the system 12. For example, the pressure differential $P_2-P_3$ could be sensed using two diffuser vanes instead of only one by forming the sensing opening 60 adjacent the pressure surface of one vane, and forming the sensing opening 62 adjacent the suction surface of another vane. Additionally, such sensing openings could be moved further downstream along a vane, be longitudinally offset along such vane, or be formed upwardly within the vane itself, turning outwardly through its opposite side surfaces. Also, the reference pressure opening 70 could be moved to a variety of alternate locations along the compressor flow path. Finally, while the system 12 has been described in conjunction with a centrifugal compressor, it can also be as advantageously used in conjunction with an axial compressor.

The foregoing detailed description is to be clearly understood as given by way of illustration and example only, the spirit and scope of this invention being limited solely by the appended claims.

What is claimed is:

1. A method of preventing surge in a compressor flowing pressurized gas through a mutually spaced series of diffuser vanes each having a leading end, trailing end, a pressure side surface, and a suction side surface, said method comprising the steps of:

(a) sensing a static pressure adjacent the pressure side surface of a diffuser vane;

(b) sensing a static pressure adjacent the suction side surface of a diffuser vane;

(c) sensing a reference static pressure;

(d) generating signal having a magnitude equal to $(P_1-P_2)/(P_1-P_3)$, where $P_1$ is the reference static pressure, $P_2$ is the static pressure sensed adjacent the vane pressure side surface, and $P_3$ is the static pressure sensed adjacent the vane suction side surface, said signal haing a magnitude indicative of the proximity of the compressor operating point to the surge line associated with such operating point; and (e) increasing the flow through the compressor, prior to the onset of surge in any portion thereof, when the magnitude of said signal reaches a predetermined value thereof.

2. Apparatus for preventing surge in a compressor flowing pressurized gas through a mutually spaced series of diffuser vanes positioned between a duality of annular diffuser plates and discharging the gas into a supply air duct or the like, each of the diffuser vanes having a leading end, a trailing end, a pressure side surface and a suction side surface, said apparatus comprising:

(a) a first sensing passage extending through a diffuser plate and positioned to receive a pressure indicative of the pressure side static pressure $P_2$ at a predetermined location along the side surface of a diffuser vane;

(b) a second sensing passage extending through a diffuser plate and positioned to receive a pressure indicative of the suction side static pressure $P_3$ at a predetermined location along the surface of a diffuser vane;

(c) a third sensing passage extending through a diffuser plte generally between an adjacent pair of diffuser vanes positioned to receive a reference static pressure $P_1$;

(d) a surge bleed outlet branch duct connected to the supply air duct;

(e) a surge bleed valve operatively positioned in said surge bleed outlet branch duct;

(f) a control unit having first, second and third inlets adapted to respectively receive pressure signals $P_2$, $P_3$ and $P_1$ and responsively generate an output signal having a magnitude equal to the parameter $(P_1-P_2)/(P_1-P_3)$;

(g) a comparator operatively connected between said control unit and said surge bleed valve to receive said output signal from said control unit, compare the magnitude of said output signal to a setpoint value of said parameter, and responsively transmit to said surge bleed valve, to modulate the same, a control signal having a magnitude indicative of the difference in magnitudes of said output signal and said setpoint value of said parameter.

3. The apparatus of claim 2 wherein said diffuser vanes have substantially identical blade angles.

4. The apparatus of claim 2 wherein said first and second sensing passages are positioned adjacent the same diffuser vane.

5. The apparatus of claim 2 wherein said second end of said third conduit is positioned between an adjacent pair of said diffuser vanes near their trailing ends.

6. The apparatus of claim 2 wherein said first and second sensing passages are respectively positioned adjacent the pressure and suction side surfaces of the same diffuser vane.

7. The apparatus of claim 2 wherein said reference static pressure $P_1$ is generated by operation of the compressor at a location downstream from the impeller section.

8. The compressor apparatus of claim 2 wherein said compressor is a centrifugal compressor.

* * * * *